US011335264B2

(12) United States Patent
Yuan et al.

(10) Patent No.: US 11,335,264 B2
(45) Date of Patent: May 17, 2022

(54) PIXEL CIRCUIT AND DRIVING METHOD THEREOF, AND DISPLAY APPARATUS

(71) Applicants: Hefei BOE Joint Technology Co., Ltd., Anhui (CN); BOE Technology Group Co., Ltd., Beijing (CN)

(72) Inventors: Zhidong Yuan, Beijing (CN); Xuehuan Feng, Beijing (CN); Yongqian Li, Beijing (CN); Can Yuan, Beijing (CN); Meng Li, Beijing (CN); Dongxu Han, Beijing (CN)

(73) Assignees: Hefei BOE Joint Technology Co., Ltd., Anhui (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/294,676

(22) PCT Filed: Aug. 7, 2020

(86) PCT No.: PCT/CN2020/107835
§ 371 (c)(1),
(2) Date: May 17, 2021

(87) PCT Pub. No.: WO2021/023302
PCT Pub. Date: Feb. 11, 2021

(65) Prior Publication Data

US 2022/0005413 A1 Jan. 6, 2022

(30) Foreign Application Priority Data

Aug. 8, 2019 (CN) ..... 201910730854.8

(51) Int. Cl.
*G09G 3/3241* (2016.01)
*G09G 3/3266* (2016.01)

(52) U.S. Cl.
CPC ..... *G09G 3/3241* (2013.01); *G09G 3/3266* (2013.01); *G09G 2300/0876* (2013.01)

(58) Field of Classification Search
CPC .. G09G 3/3233; G09G 3/3291; G09G 3/3225; G09G 3/3258; G09G 3/3208;
(Continued)

(56) References Cited

U.S. PATENT DOCUMENTS

2010/0123697 A1* 5/2010 Goh ..... G09G 3/3233 345/208
2011/0227505 A1 9/2011 Park et al.
(Continued)

FOREIGN PATENT DOCUMENTS

CA 2503237 A1 10/2006
CN 104036719 A 9/2014
(Continued)

OTHER PUBLICATIONS

International Search Report for PCT/CN2020/107835 dated Oct. 28, 2020.
(Continued)

*Primary Examiner* — Dong Hui Liang
(74) *Attorney, Agent, or Firm* — Ling Wu; Stephen Yang; Ling and Yang Intellectual Property

(57) ABSTRACT

A pixel circuit and a driving method thereof, and a display device, the pixel circuit being configured to drive a light-emitting element and including: a node control sub-circuit, which is configured to provide a first node with a signal of a data signal end and provide a second node with a signal of a control signal end under the control of a first scanning end; a driving sub-circuit, which is configured to provide the second node with a driving current under the control of the first node and the second node; a storage sub-circuit, which is configured to store electric charge between the first node
(Continued)

and the second node; a reading sub-circuit, and the light-emitting element, which is electrically connected to the second node and a second power supply end, respectively.

17 Claims, 14 Drawing Sheets

(58) Field of Classification Search
CPC ... G09G 2300/0842; G09G 2300/0819; G09G 2300/0861; G09G 2300/0426; G09G 2300/043; G09G 2320/0295; G09G 2320/0233; G09G 2320/043; G09G 2320/045; G09G 2330/12
See application file for complete search history.

(56) References Cited

U.S. PATENT DOCUMENTS

| | | | | |
|---|---|---|---|---|
| 2014/0022289 | A1* | 1/2014 | Lee | G09G 5/10 345/691 |
| 2014/0139510 | A1* | 5/2014 | Han | G09G 3/3291 345/212 |
| 2014/0252988 | A1 | 9/2014 | Azizi et al. | |
| 2015/0130865 | A1 | 5/2015 | Shim et al. | |
| 2015/0187273 | A1* | 7/2015 | Chang | G09G 3/3233 345/690 |
| 2016/0086537 | A1 | 3/2016 | Shin | |
| 2016/0189614 | A1 | 6/2016 | Tani et al. | |
| 2018/0190196 | A1 | 7/2018 | Kwon et al. | |
| 2019/0325822 | A1 | 10/2019 | Li | |
| 2020/0135094 | A1 | 4/2020 | Chen et al. | |

FOREIGN PATENT DOCUMENTS

| | | | |
|---|---|---|---|
| CN | 104637444 | A | 5/2015 |
| CN | 105741784 | A | 7/2016 |
| CN | 106935192 | A | 7/2017 |
| CN | 106991967 | A | 7/2017 |
| CN | 108269527 | A | 7/2018 |
| CN | 108597449 | A | 9/2018 |
| CN | 108877685 | A | 11/2018 |
| CN | 109192142 | A | 1/2019 |
| CN | 110288949 | A | 9/2019 |
| EP | 3633660 | A1 | 4/2020 |
| KR | 10-2014-0074661 | A | 6/2014 |
| KR | 10-2015-0033915 | A | 4/2015 |

OTHER PUBLICATIONS

Office Action dated Jun. 2, 2020 for Chinese Patent Application No. 201910730854.8 and English Translation.

* cited by examiner

PIXEL CIRCUIT AND DRIVING METHOD THEREOF, AND DISPLAY APPARATUS

The present application claims the priority of Chinese patent application No. 201910730854.8, filed to the CNIPA on Aug. 8, 2019 and entitled "Pixel Circuit and Driving Method Therefor, and Display Device", the content of which should be regarded as being incorporated into the present application by reference.

TECHNICAL FIELD

The present disclosure relates to, but is not limited to, the field of display technology, in particular to a pixel circuit and a driving method thereof, and a display apparatus.

BACKGROUND

Organic Light Emitting Diode (OLED) displays are currently one of the hotspots in the research field of displays. OLED displays have the advantages of low energy consumption, low production cost, self-luminescence, wide viewing angle and fast response. Each pixel in an OLED display includes a pixel circuit including a driving transistor to output a driving current to an OLED. Due to the limitations of the manufacturing process of driving transistors, different driving transistors differ in parameters, causing a difference in the driving current flowing through the OLED. In order to ensure the display effect, the pixel circuit is compensated in the OLED display.

SUMMARY

The following is a summary of the subject matter described in detail in the present disclosure. This summary is not intended to limit the protection scope of the claims.

In a first aspect, the present disclosure provides a pixel circuit, configured to drive a light-emitting element and including: a node control sub-circuit, a driving sub-circuit, a storage sub-circuit and a reading sub-circuit, wherein the node control sub-circuit is electrically connected with a first scanning terminal, a first node, a second node, a data signal terminal and a control signal terminal, and is configured to provide a signal of the data signal terminal to the first node and a signal of the control signal terminal to the second node, under the control of the first scanning terminal;

the driving sub-circuit is electrically connected with the first node, a first power supply terminal and the second node, and is configured to provide a driving current to the second node, under the control of the first node and the second node;

the storage sub-circuit is electrically connected with the first node and the second node, and is configured to store electric charges between the first node and the second node;

the reading sub-circuit is electrically connected with a second scanning terminal, the second node and the control signal terminal, and is configured to provide a signal of the control signal terminal to the second node or a signal of the second node to the control signal terminal, under the control of the second scanning terminal; and the light-emitting element is electrically connected with the second node and a second power supply terminal.

In some possible implementations, the node control sub-circuit includes: a first node control sub-circuit and a second node control sub-circuit, the first node control sub-circuit is electrically connected with the first scanning terminal, the data signal terminal and the first node, and is configured to provide a signal of the data signal terminal to the first node under the control of the first scanning terminal; and the second node control sub-circuit is electrically connected with the first scanning terminal, the second node and the control signal terminal, and is configured to provide a signal of the control signal terminal to the second node under the control of the first scanning terminal.

In some possible implementations, the first node control sub-circuit includes: a first switching transistor;

a control electrode of the first switching transistor is electrically connected with the first scanning terminal, a first electrode of the first switching transistor is electrically connected with the data signal terminal, and a second electrode of the first switching transistor is electrically connected with the first node.

In some possible implementations, the second node control sub-circuit includes: a second switching transistor;

a control electrode of the second switching transistor is electrically connected with the first scanning terminal, a first electrode of the second switching transistor is electrically connected with the control signal terminal, and a second electrode of the second switching transistor is electrically connected with the second node.

In some possible implementations, the driving sub-circuit includes: a driving transistor;

a control electrode of the driving transistor is electrically connected with the first node, a first electrode of the driving transistor is electrically connected with the first power supply terminal, and a second electrode of the driving transistor is electrically connected with the second node.

In some possible implementations, the storage sub-circuit includes: a storage capacitor;

a first terminal of the storage capacitor is electrically connected with the first node, and a second terminal of the storage capacitor is electrically connected with the second node.

In some possible implementations, the reading sub-circuit includes: a third switching transistor;

a control electrode of the third switching transistor is electrically connected with the second scanning terminal, a first electrode of the third switching transistor is electrically connected with the control signal terminal, and a second electrode of the third switching transistor is electrically connected with the second node.

In some possible implementations, the node control sub-circuit includes a first switching transistor and a second switching transistor, the storage sub-circuit includes a storage capacitor, the reading sub-circuit includes a third switching transistor, and the driving sub-circuit includes a driving transistor;

the control electrode of the first switching transistor is electrically connected with the first scanning terminal, the first electrode of the first switching transistor is electrically connected with the data signal terminal, and the second electrode of the first switching transistor is electrically connected with the first node;

the control electrode of the second switching transistor is electrically connected with the first scanning terminal, the first electrode of the second switching transistor is electrically connected with the control signal terminal, and the second electrode of the second switching transistor is electrically connected with the second node;

the control electrode of the third switching transistor is electrically connected with the second scanning terminal, the first electrode of the third switching transistor is electrically connected with the control signal terminal, and the second electrode of the third switching transistor is electrically connected with the second node;

the control electrode of the driving transistor is electrically connected with the first node, the first electrode of the driving transistor is electrically connected with the first power supply terminal, and the second electrode of the driving transistor is electrically connected with the second node; and the first terminal of the storage capacitor is electrically connected with the first node, and the second terminal of the storage capacitor is electrically connected with the second node.

In some possible implementations, when the signal of the first scanning terminal is at a valid level, the signal of the second scanning terminal is at an invalid level, and when the signal of the second scanning terminal is at a valid level, the signal of the first scanning terminal is at an invalid level.

In a second aspect, the present disclosure further provides a display apparatus, including: P rows and Q columns of pixel circuits, wherein P and Q are positive integers greater than 1;

the pixel circuit is the pixel circuit described above.

In some possible implementations, the second scanning terminal of the pixel circuits in the i-th row is electrically connected with the first scanning terminal of the pixel circuits in the i+1-th row, $1 \leq i \leq P-1$.

In some possible implementations, the display apparatus further includes: a gate driving circuit;

the gate driving circuit includes a P-stage shift register, an output terminal of the i-th-stage shift register is electrically connected with the first scanning terminal of the pixel circuits in the i-th row, $1 \leq i \leq P$.

In a third aspect, the present disclosure further provides a method for driving a pixel circuit, applied to the pixel circuit described above, wherein when display is driven, a driving time sequence of the pixel circuit includes a scanning stage and a sensing stage, and in the sensing stage, the method includes:

under the control of the first scanning terminal, providing, by the node control sub-circuit, a signal of the data signal terminal to the first node and a signal of the control signal terminal to the second node, and storing, by the storage sub-circuit, electric charges between the first node and the second node;

providing, by the driving sub-circuit, a driving current to the second node under the control of the first node and the second node;

providing, by the reading sub-circuit, a signal of the second node to the control signal terminal under the control of the second scanning terminal; and providing, by the reading sub-circuit, a signal of the control signal terminal to the second node under the control of the second scanning terminal.

In some possible implementations, in the scanning stage, the method includes:

under the control of the first scanning terminal, providing, by the node control sub-circuit, a signal of the data signal terminal to the first node and a signal of the control signal terminal to the second node, and storing, by the storage sub-circuit, electric charges between the first node and the second node; and providing, by the driving sub-circuit, a driving current to the second node under the control of the first node and the second node.

In some possible implementations, when the signal of the first scanning terminal is at a valid level, the signal of the second scanning terminal is at an invalid level, and when the signal of the second scanning terminal is at a valid level, the signal of the first scanning terminal is at an invalid level;

when the reading sub-circuit does not provide the signal of the second node to the control signal terminal, the signal of the control signal terminal is a reference signal.

In some possible implementations, a voltage value of the reference signal is smaller than a voltage value of the signal of the second power supply terminal.

Other aspects will become apparent upon reading and understanding accompanying drawings and the detailed description.

BRIEF DESCRIPTION OF DRAWINGS

Accompanying drawings are used to provide an understanding of technical solutions of the present disclosure and form a part of the specification. Together with embodiments of the present disclosure, they are used to explain technical solutions of the present disclosure and do not constitute a limitation on the technical solutions of the present disclosure.

DETAILED DESCRIPTION

Figure 1:
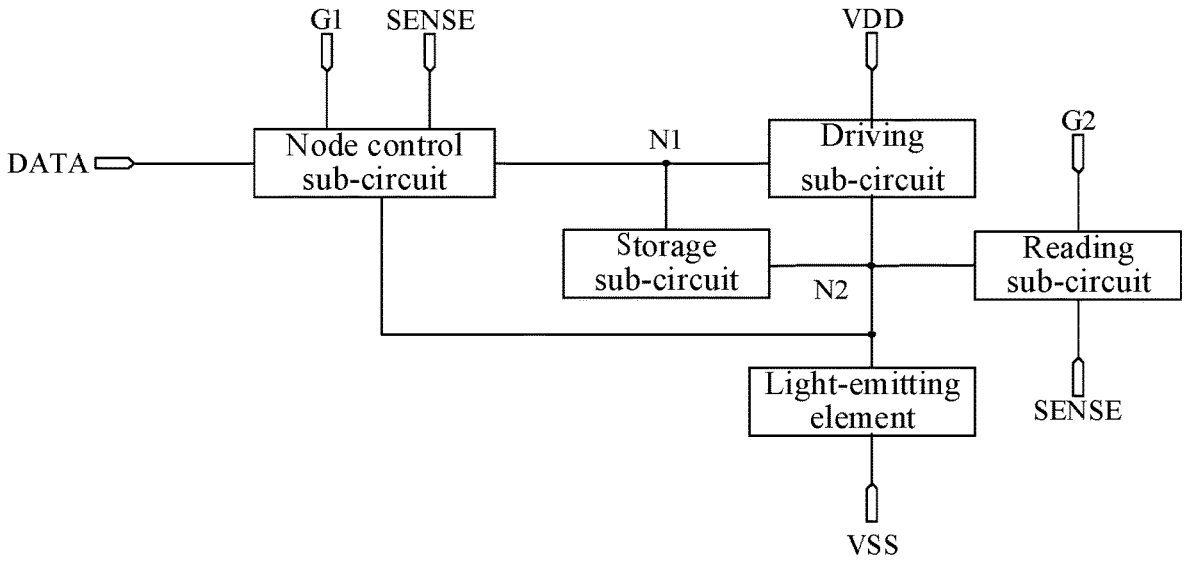
FIG. 1 is a schematic structural diagram of a pixel circuit according to an embodiment of the present disclosure.

Hereinafter embodiments of the present disclosure will be described in detail with reference to the accompanying drawings. The embodiments and features in the embodiments in the present disclosure may be combined randomly if there is no conflict.

Multiple embodiments are described in the present disclosure, but the description is exemplary rather than limiting, and for those of ordinary skills in the art, there may be more embodiments and implementation solutions within the scope of the embodiments described in the present disclosure. Although many possible combinations of features are shown in the drawings and discussed in the detailed description, many other combinations of the disclosed features are also possible. Unless specifically limited, any feature or element of any embodiment may be used in combination with or in place of any other feature or element of any other embodiment.

The present disclosure includes and contemplates combinations of features and elements known to those of ordinary skilled in the art. The disclosed embodiments, features and elements of the present disclosure may be combined with any regular features or elements to form a technical solution defined by the claims. Any feature or element of any embodiment may also be combined with features or elements from other technical solutions to form another technical solution defined by the claims. Therefore, it should be understood that any of the features shown and discussed in the present disclosure may be implemented independently or in any suitable combination. Therefore, the embodiments are not otherwise limited except the limitations in accordance with the appended claims and equivalents thereof. In addition, various modifications and changes can be made within the protection scope of the appended claims.

Unless otherwise defined, technical terms or scientific terms used in the present disclosure shall have ordinary meanings understood by those of ordinary skills in the field to which the present disclosure belongs. The words "first", "second" and the like used in the present disclosure do not indicate any order, quantity or importance, but are only used to distinguish different components. Similar words such as "including" or "containing" mean that elements or articles appearing before the word cover elements or articles listed after the word and their equivalents, without excluding other elements or articles. Similar words such as "connect" or "link" are not limited to physical or mechanical connections, but may include electrical connections, whether direct or indirect.

Both the switching transistor and the driving transistor used in the present disclosure may be thin film transistors, or field effect transistors or other devices with same characteristics. The thin film transistor used in the present disclosure may be an oxide semiconductor transistor. Since a source and a drain of a switching transistor used here are symmetrical, the source and the drain may be interchanged. In the present disclosure, to distinguish two electrodes of the switching transistor other than a gate, one of the electrodes is referred to as a first electrode and the other electrode is referred to as a second electrode. The first electrode may be a source or a drain, and the second electrode may be a drain or a source.

In a display apparatus, each pixel circuit includes: one driving transistor DTFT, two switching transistors T1 and T2, and one capacitor C. The pixel circuits in the N-th row are electrically connected with the N-th scanning signal terminal SCAN(N), the N+1-th scanning signal terminal SCAN(N+1), the data signal terminal DATA, the control signal terminal SENSE, the first power supply terminal VDD and the second power supply terminal VSS.

The display stage of the pixel circuit includes a scanning stage and a sensing stage. In the scanning stage, pixel circuits in each row are controlled to be connected with scanning signals so as to write data signals to the pixel circuits in each row, and in the sensing stage, pixel circuits in a certain row are sensed so as to externally compensate the pixel circuits. In the sensing stage, all OLEDs emit light. For sensing the pixel circuits in a certain row, the pixel circuits in the certain row are sensed by controlling the scanning signals connected with the pixel circuits in this row and the pixel circuits in the next row. In order to ensure the continuity of the display picture, after sensing pixel circuits in a certain row in the sensing stage, data signals of the pixel circuits in this row and the pixel circuits in the next row are rewritten.

The pixel circuits in the N-th row are randomly selected for sensing. The sensing stage includes: a first stage and a second stage. In the first stage, signals of the N-th scanning signal terminal SCAN(N) and the N+1-th scanning signal terminal SCAN(N+1) are at valid levels, so that the two switching transistors T1 and T2 are both turned on, and at this time, the data signals of the data signal terminal DATA are written not only to the nodes of the pixel circuits in the N-th row, but also to the nodes of the pixel circuits in the N+1-th row. The N+2-th scanning signal terminal SCAN (N+2) provides an invalid level, and the nodes in the pixel circuits in the N+1-th row are in a floating state. In the second stage, the N-th scanning signal terminal SCAN(N) provides an invalid level, the N+1-th scanning signal terminal SCAN(N+1) continuously provides a valid level signal, and the control signal terminal SENSE reads the signal of the node of the N-th pixel circuit. In order to ensure the continuity of the display picture, after the control signal terminal SENSE reads the signal of the node of the N-th pixel circuit, data signals are rewritten to the pixel circuits in the N-th row and the pixel circuits in the N+1-th row to ensure normal display of the pixels in the N-th row and the pixels in the N+1-th row. At the time of writing data signals to the pixel circuits in the N-th row, the signals of the data signal terminal DATA required by the pixel circuits in the N-th row have been written to the nodes in the pixel circuits in the N+1-th row, and since the N+2-th scanning signal terminal SCAN(N+2) provides an invalid level, the nodes in the pixel circuits in the N+1-th row are in a floating state, so that data signals cannot be normally written to the pixel circuits in the N+1-th row, and as a result, the OLEDs driven by the pixel circuits in the N+1-th row cannot emit light normally, which affects the display effect.

FIG. 1 is a schematic structural diagram of a pixel circuit according to an embodiment of the present disclosure. As shown in FIG. 1, the pixel circuit according to an embodiment of the present disclosure is configured to drive a light-emitting element, and the pixel circuit includes: a node control sub-circuit, a driving sub-circuit, a storage sub-circuit and a reading sub-circuit.

The node control sub-circuit is electrically connected with the first scanning terminal G1, the first node N1, the second node N2, the data signal terminal DATA and the control signal terminal SENSE, and is configured to provide a signal of the data signal terminal DATA to the first node N1 and a signal of the control signal terminal SENSE to the second node N2 under the control of the first scanning terminal G1. The driving sub-circuit is electrically connected with the first node N1, the first power supply terminal VDD and the second node N2, and is configured to provide a driving current to the second node N2 under the control of the first node N1 and the second node N2. The storage sub-circuit is electrically connected with the first node N1 and the second node N2, and is configured to store electric charges between the first node N1 and the second node N2. The reading sub-circuit is electrically connected with the second scanning terminal G2, the second node N2 and the control signal terminal SENSE, and is configured to provide a signal of the control signal terminal SENSE to the second node N2 or provide a signal of the second node N2 to the control signal terminal SENSE, under the control of the second scanning terminal G2.

In an exemplary embodiment, the light-emitting element is electrically connected with the second node N2 and the second power supply terminal VSS.

In an exemplary embodiment, the light-emitting element may be an organic light-emitting diode OLED. The anode of the OLED is electrically connected with the second node N2, and the cathode of the OLED is electrically connected with the second power supply terminal VSS.

In an exemplary embodiment, the signal of the first power supply terminal VDD may continue to be a high level signal. The voltage value of the signal of the first power supply terminal VDD may be greater than or equal to 5 volts.

In an exemplary embodiment, the signal of the second power supply terminal VSS may continue to be a low level signal. The voltage value of the signal of the second power supply terminal VSS may be smaller than the voltage value of the signal of the first power supply terminal VDD.

In an exemplary embodiment, the control signal terminal SENSE may provide a signal and may also read the signal of the second node N2. The signal read by the control signal terminal SENSE is configured to acquire parameters of the transistors in the driving sub-circuit, so as to externally compensate the data signal terminal DATA, which can reduce the difference in the driving currents flowing to the light-emitting elements.

In an exemplary embodiment, the signal of the control signal terminal SENSE is a reference signal. The voltage value of the reference signal is smaller than the voltage value of the signal of the second power supply terminal VSS.

In an exemplary embodiment, the control signal terminals SENSE to which different pixel circuits are connected are the same signal terminal.

The pixel circuit provided by an embodiment of the present disclosure is configured to drive a light-emitting element. The pixel circuit includes: a node control sub-circuit, a driving sub-circuit, a storage sub-circuit and a reading sub-circuit. The node control sub-circuit is electrically connected with the first scanning terminal, the first node, the second node, the data signal terminal and the control signal terminal, and is configured to provide a signal of the data signal terminal to the first node and a signal of the control signal terminal to the second node, under the control of the first scanning terminal. The driving sub-circuit is electrically connected with the first node, the first power supply terminal and the second node, and is configured to provide a driving current to the second node under the control of the first node and the second node. The storage sub-circuit is electrically connected with the first node and the second node, and is configured to store electric charges between the first node and the second node. The reading sub-circuit is electrically connected with the second scanning terminal, the second node and the control signal terminal, and is configured to provide a signal of the control signal terminal to the second node or a signal of the second node to the control signal terminal, under the control of the second scanning terminal. The light-emitting element is electrically connected with the second node and the second power supply terminal. The node control sub-circuit provided by an embodiment of the present disclosure provides a signal of the control signal terminal to the second node through the first scanning terminal, which can ensure normal writing of the data signals to the pixel circuits in a next row after sensing of the pixel circuits in a certain row in the sensing stage, thus ensuring normal display and improving the display effect.

Figure 2:
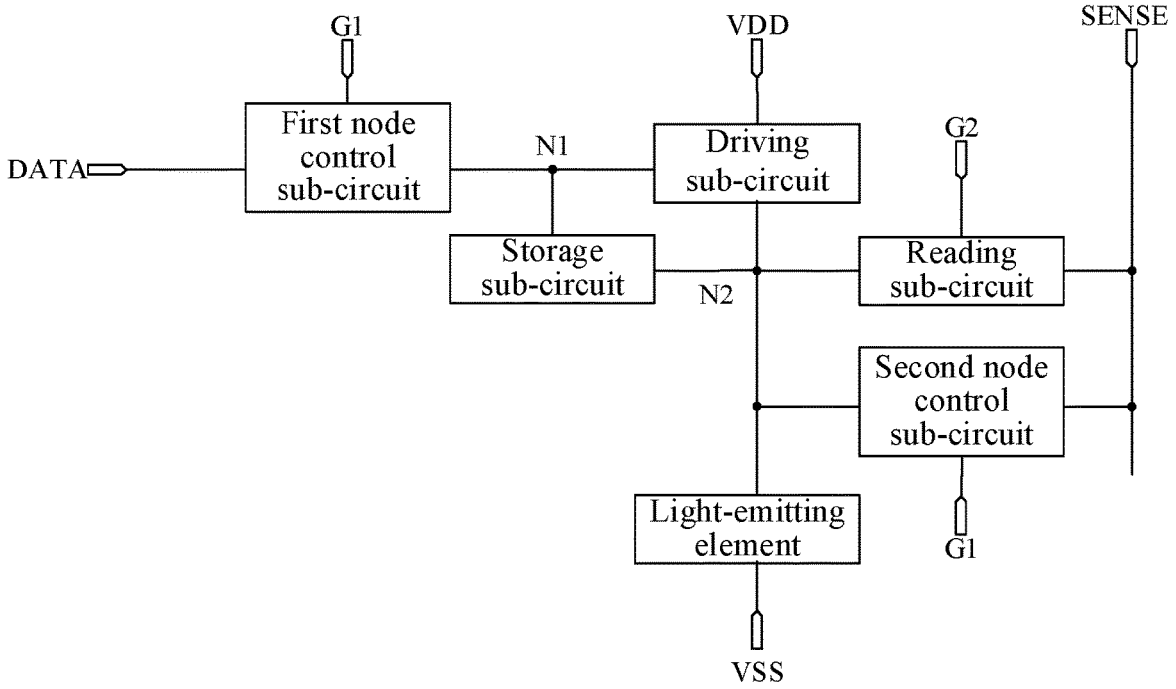
FIG. 2 is a schematic structural diagram of a pixel circuit according to an exemplary embodiment.

FIG. 2 is a schematic structural diagram of a pixel circuit according to an exemplary embodiment. As shown in FIG. 2, the node control sub-circuit in the pixel circuit provided by an embodiment of the present disclosure includes: a first node control sub-circuit and a second node control sub-circuit.

The first node control sub-circuit is electrically connected with the first scanning terminal G1, the data signal terminal DATA and the first node N1, and is configured to provide a signal of the data signal terminal DATA to the first node N1 under the control of the first scanning terminal G1. The second node control sub-circuit is electrically connected with the first scanning terminal G1, the second node N2 and the control signal terminal SENSE, and is configured to provide a signal of the control signal terminal SENSE to the second node N2 under the control of the first scanning terminal G1.

In an exemplary implementation, the first node control sub-circuit may control the signal of the first node N1, and the second node control sub-circuit may control the signal of the second node N2.

Figure 3:
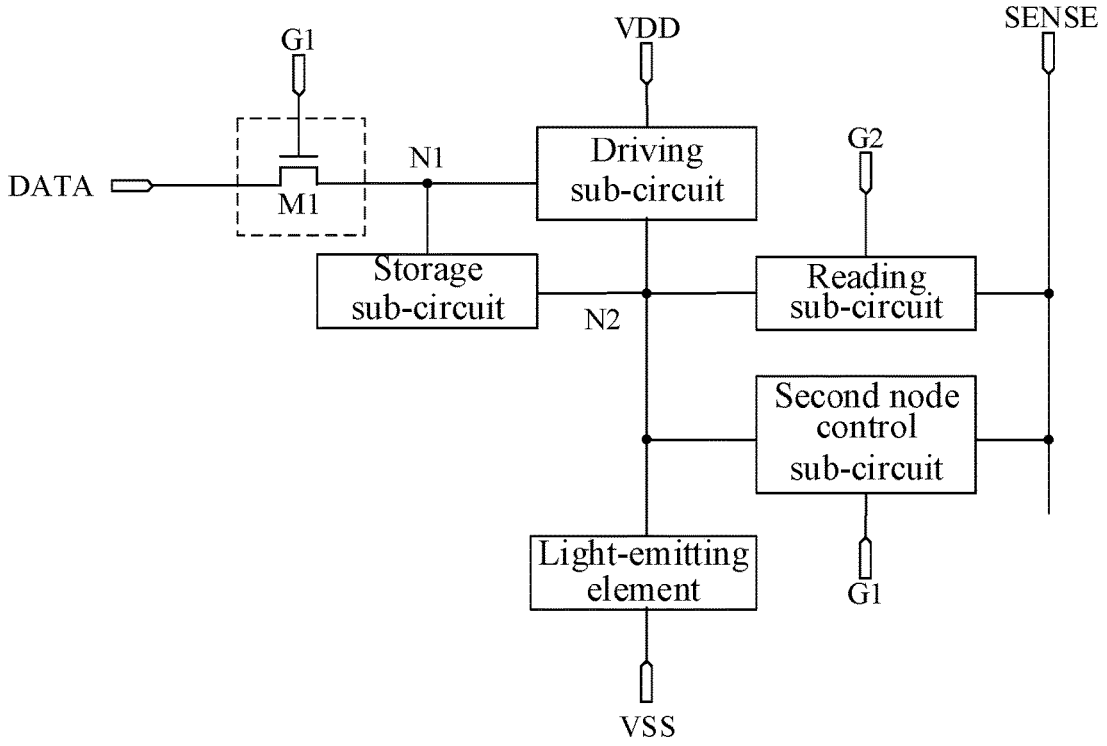
FIG. 3 is an equivalent circuit diagram of a first node control sub-circuit according to an exemplary embodiment.

FIG. 3 is an equivalent circuit diagram of a first node control sub-circuit according to an exemplary embodiment. As shown in FIG. 3, the first node control sub-circuit provided by an exemplary embodiment includes: a first switching transistor M1.

The control electrode of the first switching transistor M1 is electrically connected with the first scanning terminal G1, the first electrode of the first switching transistor M1 is electrically connected with the data signal terminal DATA, and the second electrode of the first switching transistor M1 is electrically connected with the first node N1.

FIG. 3 shows an exemplary structure of the first node control sub-circuit. The implementation of the first node control sub-circuit is not limited to this.

Figure 4:
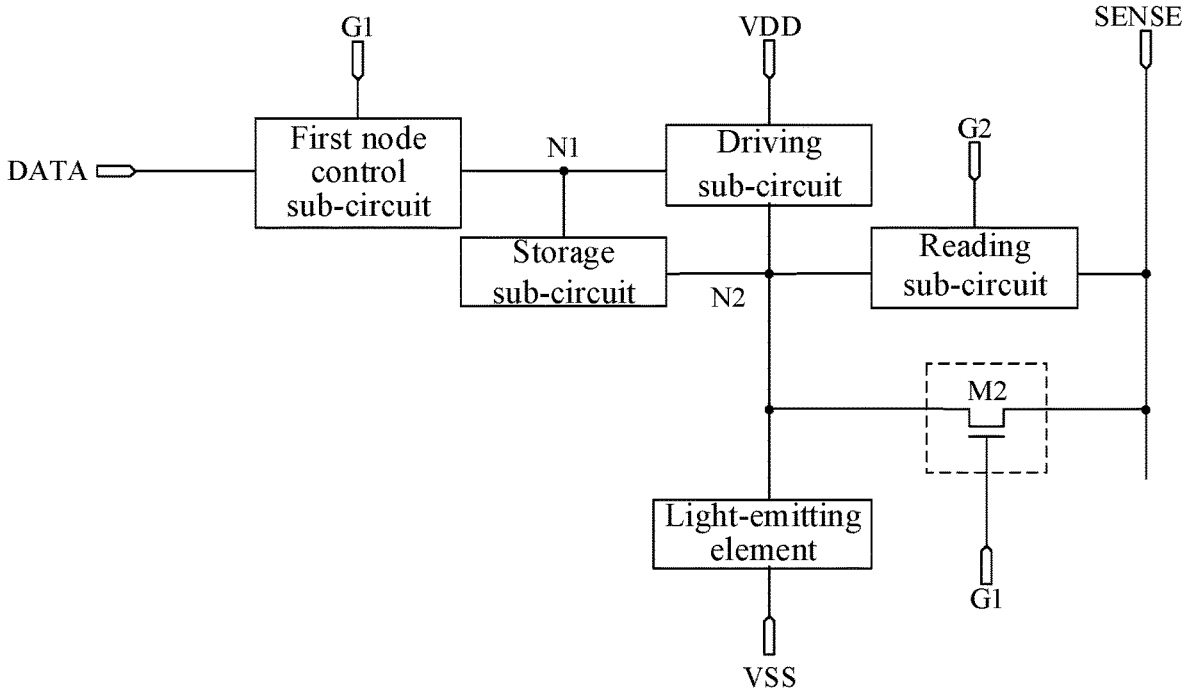
FIG. 4 is an equivalent circuit diagram of a second node control sub-circuit according to an exemplary embodiment.

FIG. 4 is an equivalent circuit diagram of a second node control sub-circuit according to an exemplary embodiment. As shown in FIG. 4, the second node control sub-circuit provided by an exemplary embodiment includes: a second switching transistor M2.

The control electrode of the second switching transistor M2 is electrically connected with the first scanning terminal G1, the first electrode of the second switching transistor M2 is electrically connected with the control signal terminal SENSE, and the second electrode of the second switching transistor M2 is electrically connected with the second node N2.

FIG. 4 shows an exemplary structure of the second node control sub-circuit. The implementation of the second node control sub-circuit is not limited to this.

Figure 5:
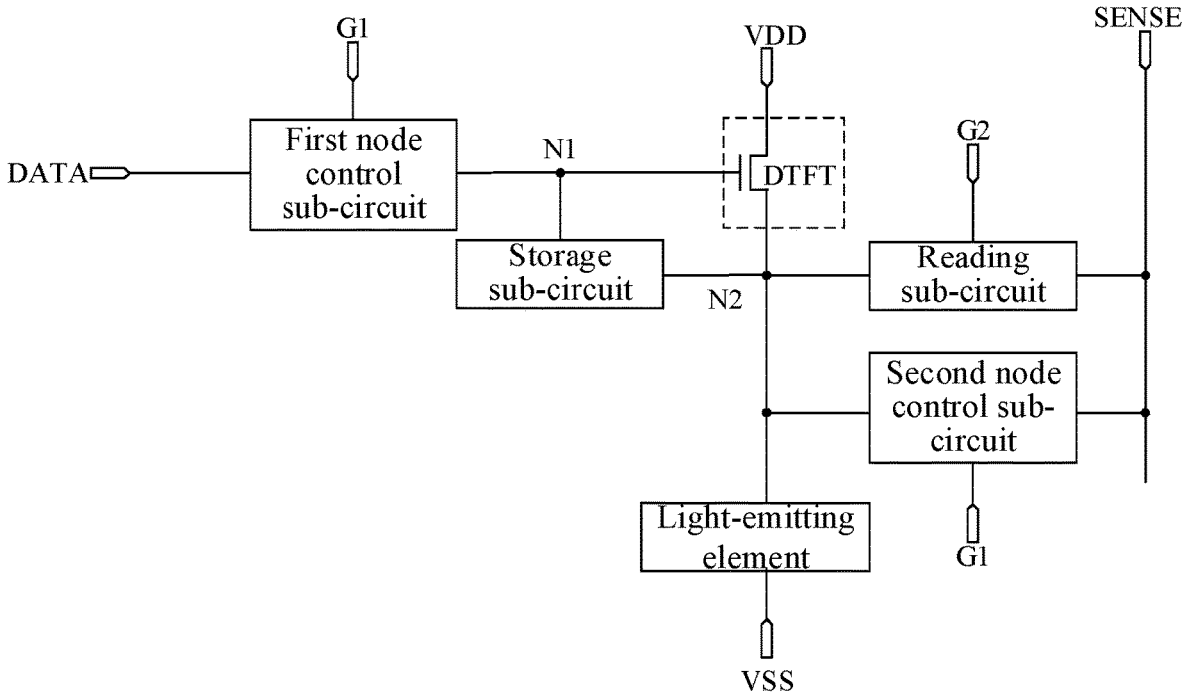
FIG. 5 is an equivalent circuit diagram of a driving sub-circuit according to an exemplary embodiment.

FIG. 5 is an equivalent circuit diagram of a driving sub-circuit according to an exemplary embodiment. As shown in FIG. 5, the driving sub-circuit provided by an exemplary embodiment includes: a driving transistor DTFT.

The control electrode of the driving transistor DTFT is electrically connected with the first node N1, the first electrode of the driving transistor DTFT is electrically connected with the first power supply terminal VDD, and the second electrode of the driving transistor DTFT is electrically connected with the second node N2.

FIG. 5 shows an exemplary structure of the driving sub-circuit. The implementation of the driving sub-circuit is not limited to this.

Figure 6:
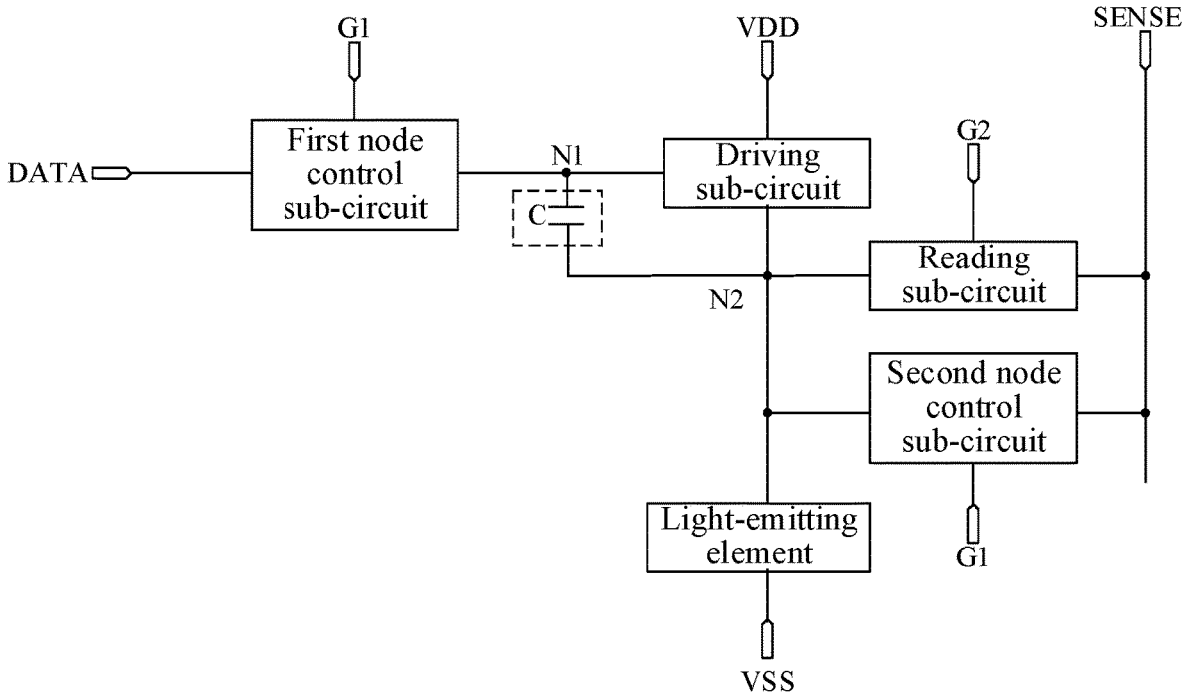
FIG. 6 is an equivalent circuit diagram of a storage sub-circuit according to an exemplary embodiment.

FIG. 6 is an equivalent circuit diagram of a storage sub-circuit according to an exemplary embodiment. As shown in FIG. 6, the storage sub-circuit provided by an exemplary embodiment includes: a storage capacitor C.

The first terminal of the storage capacitor C is electrically connected with the first node N1, and the second terminal of the storage capacitor C is electrically connected with the second node N2.

FIG. 6 shows an exemplary structure of the storage sub-circuit. The implementation of the storage sub-circuit is not limited to this.

Figure 7:
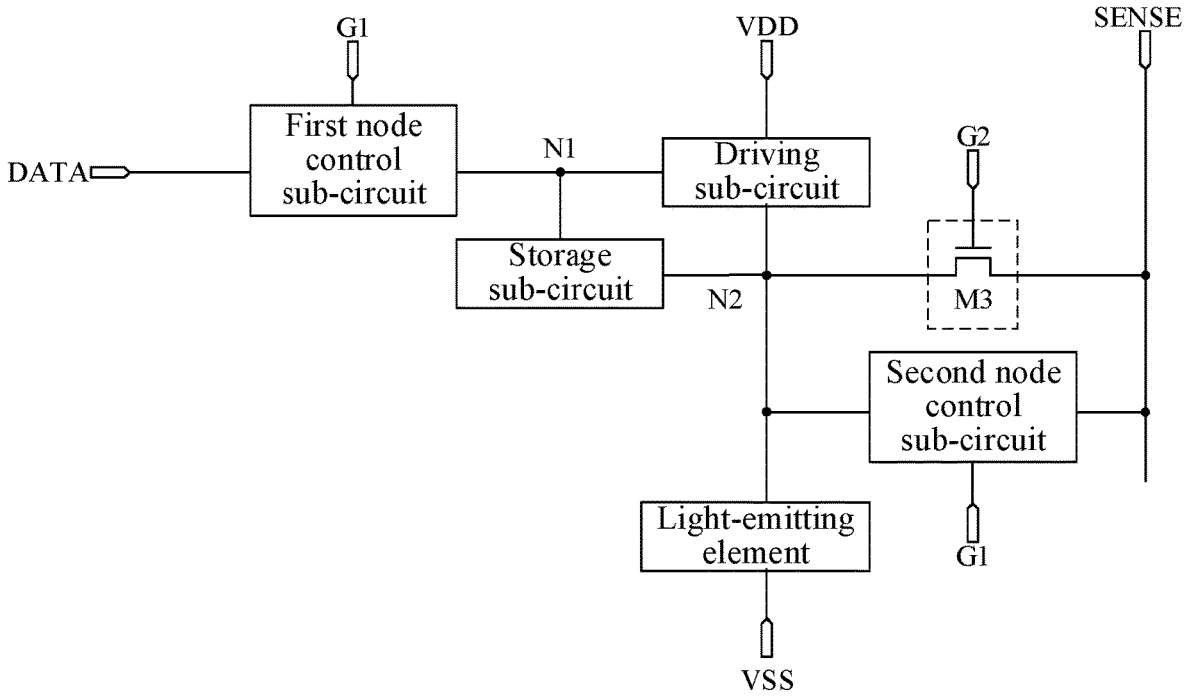
FIG. 7 is an equivalent circuit diagram of a reading sub-circuit according to an embodiment of the present disclosure.

FIG. 7 is an equivalent circuit diagram of a reading sub-circuit according to an embodiment of the present disclosure. As shown in FIG. 7, the reading sub-circuit provided by an exemplary embodiment includes: a third switching transistor M3.

The control electrode of the third switching transistor M3 is electrically connected with the second scanning terminal G2, the first electrode of the third switching transistor M3 is electrically connected with the control signal terminal SENSE, and the second electrode of the third switching transistor M3 is electrically connected with the second node N2.

FIG. 7 shows an exemplary structure of the reading sub-circuit. The implementation of the reading sub-circuit is not limited to this.

Figure 8:
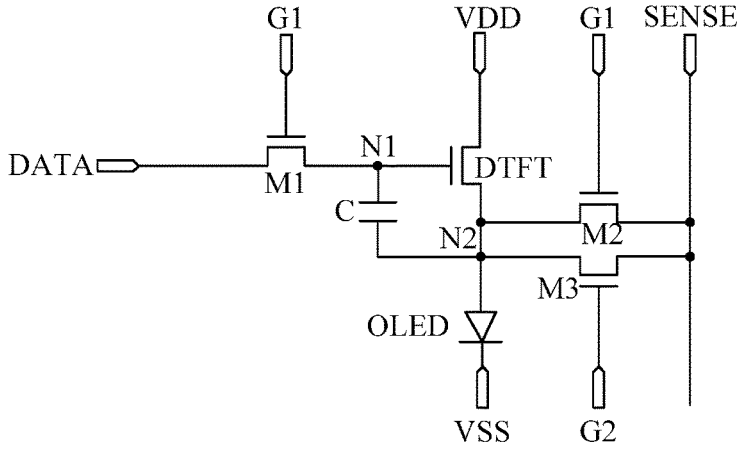
FIG. 8 is an equivalent circuit diagram of a pixel circuit according to an exemplary embodiment.

FIG. 8 is an equivalent circuit diagram of a pixel circuit according to an exemplary embodiment. As shown in FIG. 8, in the pixel circuit provided by an exemplary embodiment, the node control sub-circuit includes: a first switching transistor M1 and a second switching transistor M2, the storage sub-circuit includes: a storage capacitor C, the reading sub-circuit includes: a third switching transistor M3, and the driving sub-circuit includes: a driving transistor DTFT.

The control electrode of the first switching transistor M1 is electrically connected with the first scanning terminal G1, the first electrode of the first switching transistor M1 is electrically connected with the data signal terminal, and the second electrode of the first switching transistor M1 is electrically connected with the first node N1. The control electrode of the second switching transistor M2 is electrically connected with the first scanning terminal G1, the first electrode of the second switching transistor M2 is electrically connected with the control signal terminal SENSE, and the second electrode of the second switching transistor M2 is electrically connected with the second node N2. The control electrode of the third switching transistor M3 is electrically connected with the second scanning terminal G2, the first electrode of the third switching transistor M3 is electrically connected with the control signal terminal SENSE, and the second electrode of the third switching transistor M3 is electrically connected with the second node N2. The control electrode of the driving transistor DTFT is electrically connected with the first node N1, the first electrode of the driving transistor DTFT is electrically connected with the first power supply terminal VDD, and the second electrode of the driving transistor DTFT is electrically connected with the second node N2. The first terminal of the storage capacitor C is electrically connected with the first node N1, and the second terminal of the storage capacitor C is electrically connected with the second node N2.

In an exemplary embodiment, the first scanning terminal G1 and the second scanning terminal G2 do not provide valid level signals at the same time. When the signal of the first scanning terminal G1 is at a valid level, the signal of the second scanning terminal G2 is at an invalid level; and when the signal of the second scanning terminal G2 is at a valid level, the signal of the first scanning terminal G1 is at an invalid level.

In an exemplary embodiment, when the signal of the first scanning terminal G1 is at an invalid level, the signal of the second scanning terminal G2 is also at an invalid level; and when the signal of the second scanning terminal G2 is at an invalid level, the signal of the first scanning terminal G1 is also at an invalid level.

A valid level refers to a level capable of turning on a transistor, and an invalid level refers to a level capable of turning off a transistor. When the transistor is a P-type transistor, the valid level is a low level and the invalid level is a high level. When the transistor is an N-type transistor, the valid level is a high level and the invalid level is a low level.

In an exemplary embodiment, the driving transistor DTFT, the first switching transistor M1, the second switching transistor M2 and the third switching transistor M3 may be N-type thin film transistors or may be P-type thin film transistors. When the driving transistor DTFT, the first switching transistor M1, the second switching transistor M2 and the third switching transistor M3 are of the same transistor type, the process flow may be unified and the process of the OLED display may be simplified, which helps to improve the yield of products of the OLED display.

Figure 9:
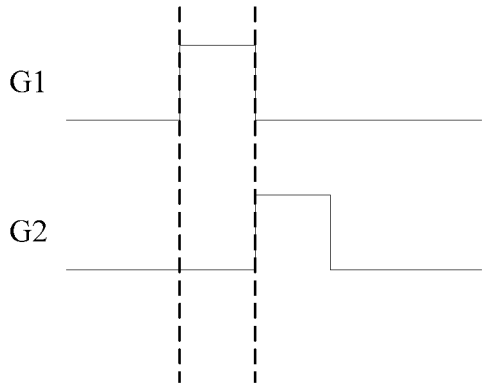
FIG. 9 is a timing diagram of a pixel circuit in a scanning stage according to an exemplary embodiment.
Figure 10:
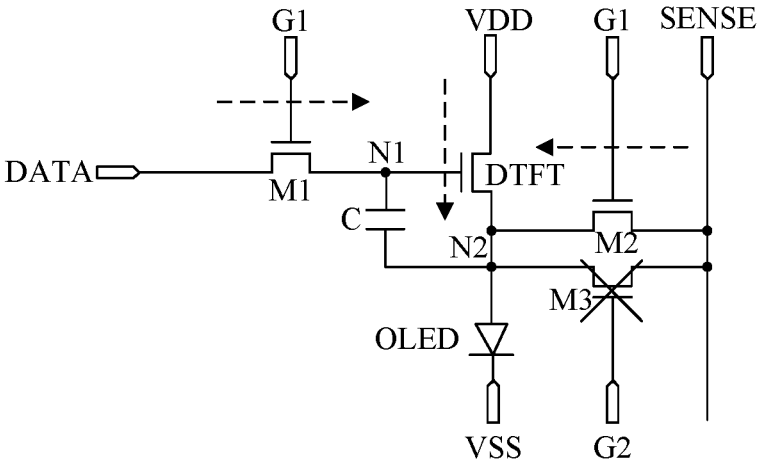
FIG. 10 is a working state diagram of a pixel circuit in the scanning stage according to an exemplary embodiment.
Figure 11:
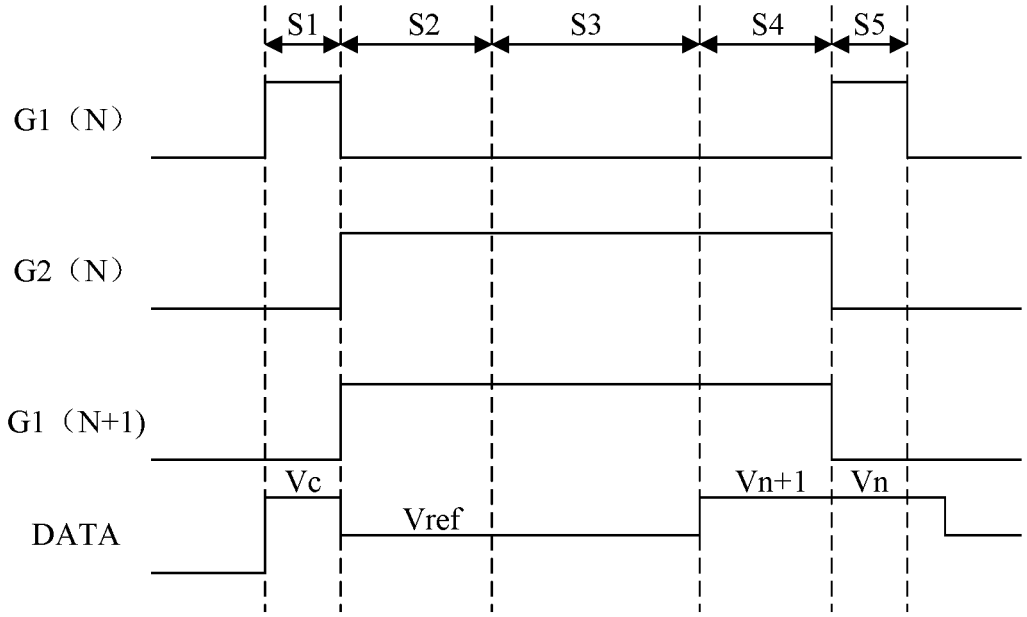
FIG. 11 is a timing diagram of pixel circuits in the N-th row and the N+1-th row in a sensing stage according to an exemplary embodiment.
Figure 12A:
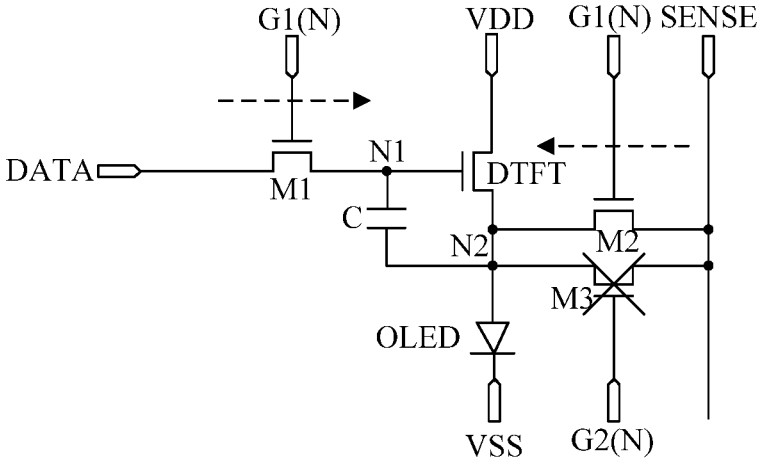
FIG. 12A is a working state diagram of the pixel circuits in the N-th row in a first stage according to an exemplary embodiment.
Figure 12B:
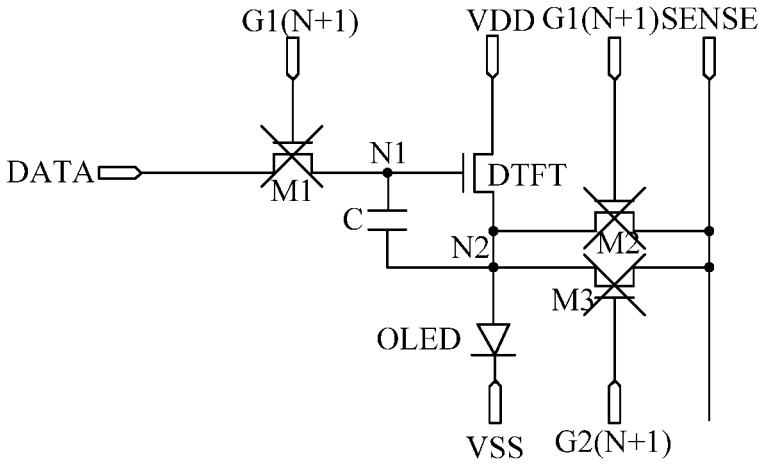
FIG. 12B is a working state diagram of the pixel circuits in the N+1-th row in the first stage according to an exemplary embodiment.
Figure 13A:
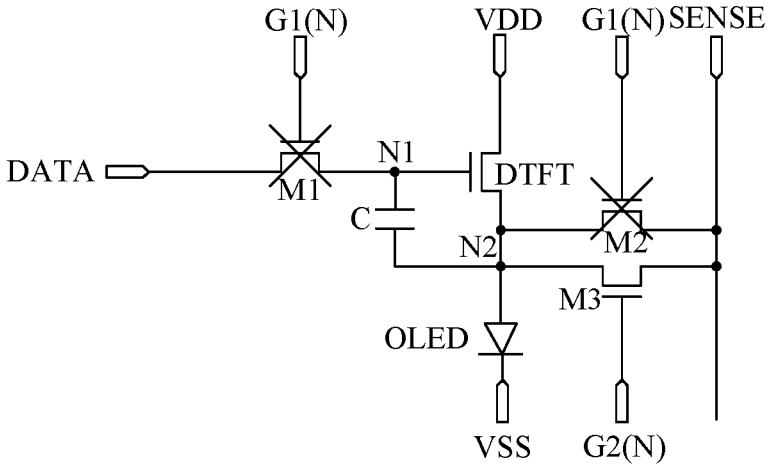
FIG. 13A is a working state diagram of the pixel circuits in the N-th row in a second stage according to an exemplary embodiment.
Figure 13B:
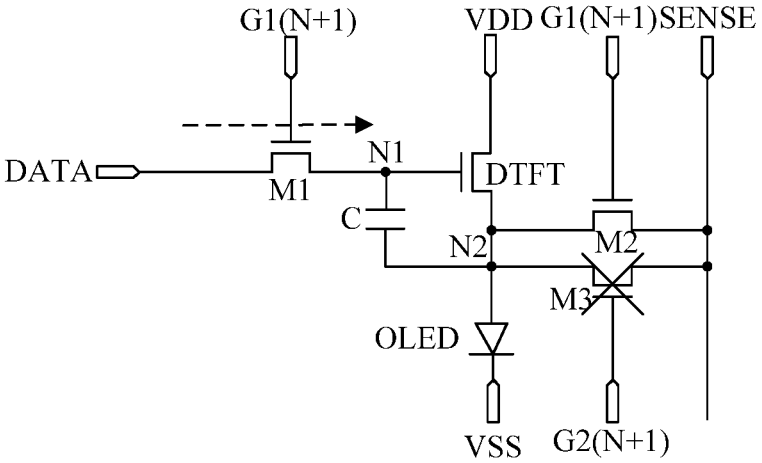
FIG. 13B is a working state diagram of the pixel circuits in the N+1-th row in the second stage according to an exemplary embodiment.
Figure 14A:
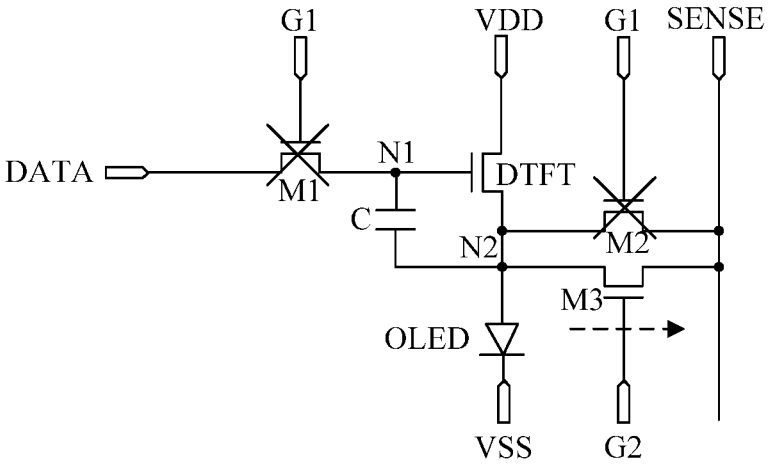
FIG. 14A is a working state diagram of the pixel circuits in the N-th row in a third stage according to an exemplary embodiment.
Figure 14B:
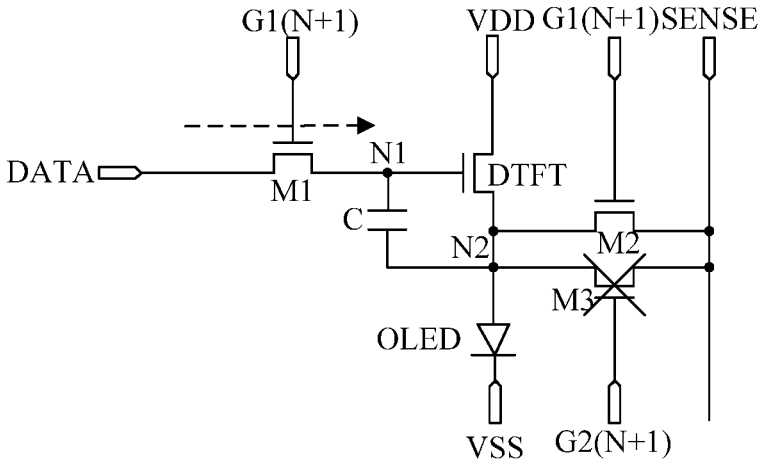
FIG. 14B is a working state diagram of the pixel circuits in the N+1-th row in the third stage according to an exemplary embodiment.
Figure 15A:
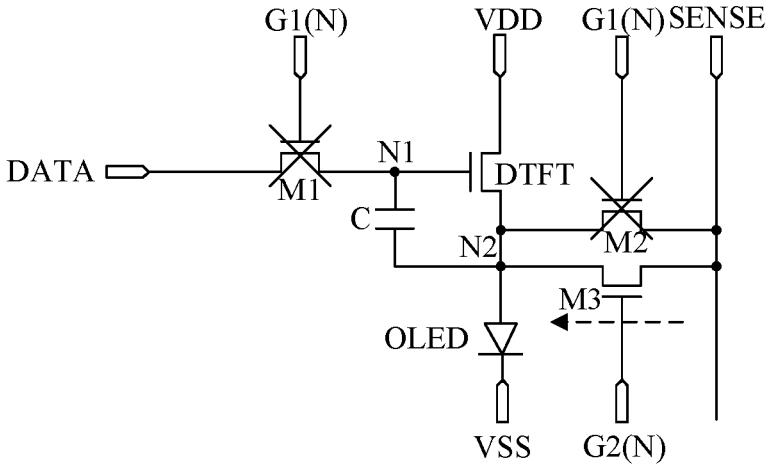
FIG. 15A is a working state diagram of the pixel circuits in the N-th row in a fourth stage according to an exemplary embodiment.
Figure 15B:
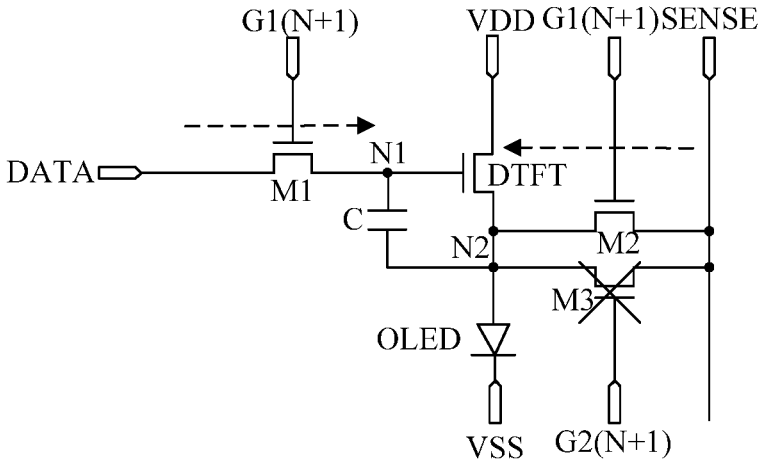
FIG. 15B is a working state diagram of the pixel circuits in the N+1-th row in the fourth stage according to an exemplary embodiment.
Figure 16A:
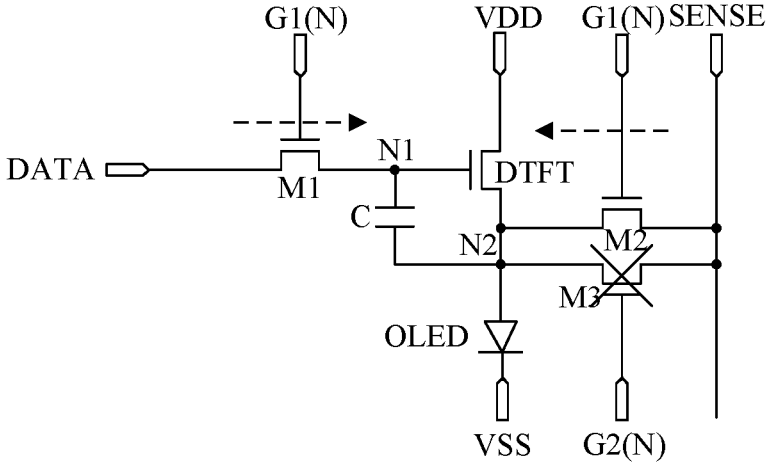
FIG. 16A is a working state diagram of the pixel circuits in the N-th row in a fifth stage according to an exemplary embodiment.
Figure 16B:
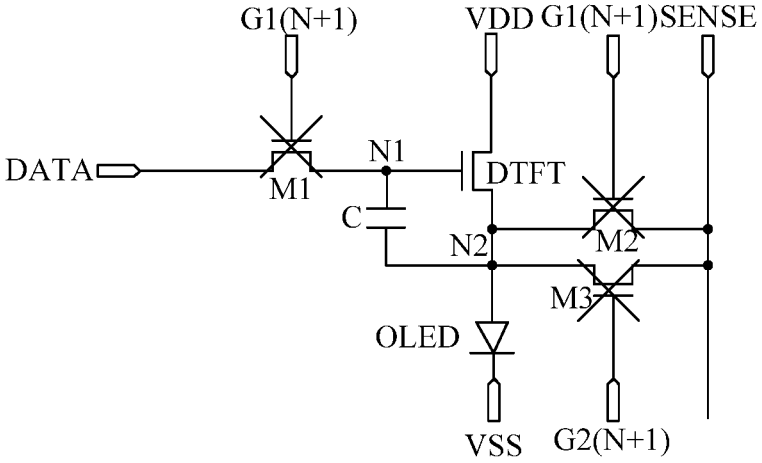
FIG. 16B is a working state diagram of the pixel circuits in the N+1-th row in the fifth stage according to an exemplary embodiment.

A case where the switching transistors M1 to M3 in a pixel circuit provided by an exemplary embodiment are all N-type thin film transistors and the pixel circuits in the N-th row are sensed is taken as an example. FIG. 9 is a timing diagram of a pixel circuit in a scanning stage according to an exemplary embodiment, FIG. 10 is a working state diagram of a pixel circuit in the scanning stage according to an exemplary embodiment, FIG. 11 is a timing diagram of pixel circuits in the N-th row and the N+1-th row in a sensing stage according to an exemplary embodiment, FIG. 12A is a working state diagram of the pixel circuits in the N-th row in a first stage according to an exemplary embodiment, FIG. 12B is a working state diagram of the pixel circuits in the N+1-th row in the first stage according to an exemplary embodiment, FIG. 13A is a working state diagram of the pixel circuits in the N-th row in a second stage according to an exemplary embodiment, FIG. 13B is a working state diagram of the pixel circuits in the N+1-th row in the second stage according to an exemplary embodiment, FIG. 14A is a working state diagram of the pixel circuits in the N-th row in a third stage according to an exemplary embodiment, FIG. 14B is a working state diagram of the pixel circuits in the N+1-th row in the third stage according to an exemplary embodiment, FIG. 15A is a working state diagram of the pixel circuits in the N-th row in a fourth stage according to an exemplary embodiment, FIG. 15B is a working state diagram of the pixel circuits in the N+1-th row in the fourth stage according to an exemplary embodiment, FIG. 16A is a working state diagram of the pixel circuits in the N-th row in a fifth stage according to an exemplary embodiment, and FIG. 16B is a working state diagram of the pixel circuits in the N+1-th row in the fifth stage according to an exemplary embodiment. As shown in FIG. 8 to FIG. 16, the pixel circuit involved in an exemplary embodiment includes: three switching transistors (M1 to M3), one driving transistor (DTFT), one capacitor unit (C), and six input terminals (DATA, G1, G2, SENSE, VDD and VSS), wherein Gi(j) is the i-th scanning terminal of the pixel circuits in the j-th row.

The first power supply terminal VDD continuously provides high level signals. The second power supply terminal VSS continuously provides low level signals. The signal input by the control signal terminal SENSE is a reference signal, and the voltage value of the reference signal is smaller than the voltage value of the signal of the second power supply terminal VSS.

In the scanning stage, the working process of the pixel circuit provided by an exemplary embodiment includes the following. As shown in FIGS. 9 and 10, the input signal of the first scanning terminal G1 is at a high level, the first switching transistor M1 is turned on to provide the signal input by the data signal terminal DATA to the first node N1, at this time, $V_d=V_n$ is satisfied for the voltage value $V_d$ of the signal input by the data signal terminal DATA, $V_n$ is the data signal required by the pixels in the scanning stage, and $V_1=V_n$ is satisfied for the voltage value $V_1$ of the first node N1. The second switching transistor M2 is turned on to provide the signal input by the control signal terminal SENSE to the second node N2. At this time, the signal input by the control signal terminal SENSE is a reference signal, the voltage value of the reference signal is $V_{ref}$, and $V_2=V_{ref}$ is satisfied for the voltage value $V_2$ of the second node N2. The storage capacitor C stores electric charges between the first node N1 and the second node N2. Because $V_n-V_{ref}>V_{th}$, $V_{th}$ is a threshold voltage of the driving transistor DTFT, at this time, the driving transistor DTFT is turned on to supply a driving current to the OLED. The input signal of the second scanning terminal G2 is at a low level, and the control signal terminal SENSE does not read the signal of the second node N2.

The signal input by the data signal terminal DATA is a data signal after external compensation. In the scanning stage, rows of pixel circuits have the same working process.

In the sensing stage, except the first scanning terminal G1(N) and the second scanning terminal G2(N) of the pixel circuits in the N-th row and the first scanning terminal G1(N+1) of the pixel circuits in the (N+1)-th row, the second scanning terminal G2(N+1) of the pixel circuits in the N+1-th row and the first scanning terminal and the second scanning terminal of the other pixel circuits continuously provide low level signals, and a driving current is output under the effect of the data signals input in the scanning stage. The sensing stage includes: a first stage S1, a second stage S2, a third stage S3, a fourth stage S4 and a fifth stage S5.

In the sensing stage, the working process of the pixel circuits in the N-th row and the N+1-th row provided by an exemplary embodiment include the following.

In the first stage S1, as shown in FIGS. 11, 12A and 12B, in the pixel circuits in the N-th row, the input signal of the first scanning terminal G1(N) is at a high level, and the first switching transistor M1 is turned on to provide the signal input by the data signal terminal DATA to the first node N1. At this time, $V_d=V_c$ is satisfied for the voltage value $V_d$ of the signal input by the data signal terminal DATA, and $V_1=V_c$ is satisfied for the voltage value $V_1$ of the first node N1. The second switching transistor M2 is turned on to provide the signal input by the control signal terminal SENSE to the second node N2. At this time, the signal input by the control signal terminal SENSE is a reference signal, the voltage value of the reference signal is $V_{ref}$, and $V_2=V_{ref}$ is satisfied for the voltage value V2 of the second node N2. The storage capacitor C stores electric charges between the first node N1 and the second node N2. Because $V_c-V_{ref}>V_{th}$, at this time, the driving transistor DTFT is turned on, and at this time, the input signal of the first scanning terminal G1(N+1) of the pixel circuits in the N+1-th row is at a low level, and the pixel circuits in the N+1-th row still outputs a driving current under the effect of the data signal input in the scanning stage.

No matter which row of pixel circuits are randomly selected for sensing, in the first stage, the voltage values of the signals input by the data signal terminal DATA are all $V_c$.

In the second stage S2, as shown in FIGS. 11, 13A and 13B, in the pixel circuits in the N-th row, the input signal of the first scanning terminal G1(N) is at a low level, and the first switching transistor M1 and the second switching transistor M2 are turned off. Since the driving transistor DTFT is turned on, the first power supply terminal VDD charges the second node N2 until $V_2=V_c-V_{th}$ is satisfied for the voltage value $V_2$ of the second node N2. At this time, the driving transistor DTFT is turned off, the input signal of the second scanning terminal G2(N) is at a high level, the third switching transistor M3 is turned on, but no signal is input by the control signal terminal SENSE, and the second node N2 is in a floating state. In the pixel circuits in the N+1-th row, the input signal of the first scanning terminal G1(N+1) is at a high level, and the first transistor M1 and the second transistor M2 are turned on. At this time, $V_d-V_{ref}$ is satisfied for the voltage value $V_d$ of the signal of the data signal terminal DATA, no signal is input by the control signal terminal SENSE, the second nodes N2 in the pixel circuits in the N+1-th row are in a floating state, and the pixel circuits in the N+1-th row cannot output a driving current.

In the third stage S3, as shown in FIGS. 11, 14A and 14B, in the pixel circuits in the N-th row, the input signal of the second scanning terminal G2(N) is continuously at a high level, the third switching transistor M3 is continuously turned on, and the control signal terminal SENSE reads the signal of the second node N2 to complete sensing of the pixel circuits in the N-th row. In the pixel circuits in the N+1-th row, the input signal of the first scanning terminal G1(N+1) is at a high level, and the first transistor M1 and the second transistor M2 are turned on. At this time, $V_d=V_{ref}$ is satisfied for the voltage value $V_d$ of the signal of the data signal terminal DATA, no signal is input by the control signal terminal SENSE, the second nodes N2 in the pixel circuits in the N+1-th row are in a floating state, and the pixel circuits in the N+1-th row cannot output a driving current.

In the fourth stage S4, as shown in FIGS. 11, 15A and 15B, in the pixel circuits in the N-th row, the input signal of the second scanning terminal G2(N) is continuously at a high level, and the third switching transistor M3 is continuously turned on to provide a signal input by the control signal terminal SENSE to the second node N2. At this time, the signal input by the control signal terminal SENSE is a reference signal, the voltage value of the reference signal is $V_{ref}$, $V_2=V_{ref}$ is satisfied for the voltage value $V_2$ of the second node N2, but because the data signal of the first scanning terminal G1(N) is at a low level, the first transistor M1 and the second transistor M2 are turned off. In the pixel circuits in the N+1-th row, the input signal of the first scanning terminal G1(N+1) is at a high level, the first switching transistor M1 and the second switching transistor M2 are turned on, $V_d=V_{n+1}$ is satisfied for the voltage value $V_d$ of the signal input by the data signal terminal DATA, $V_1=V_{n+1}$ is satisfied for the voltage value $V_1$ of the first node N1, and $V_2=V_{ref}$ is satisfied for the voltage value $V_2$ of the second node N2, which can achieve writing data signals to the pixel circuits in the N+1-th row, so that the pixel circuits in the N+1-th row output a driving current again, thereby ensuring the display effect.

In the fifth stage S5, as shown in FIGS. 11, 16A and 16B, in the pixel circuits in the N-th row, the input signal of the second scanning terminal G2(N) is at a low level, the third switching transistor M3 is turned off, the input signal of the first scanning terminal G1(N) is at a high level, and the first switching transistor M1 is turned on to provide the signal input by the data signal terminal DATA to the first node N1. At this time, $V_d=V_n$ is satisfied for the voltage value $V_d$ of the signal input by the data signal terminal DATA, $V_1=V_n$ is satisfied for the voltage value $V_1$ of the first node N1, the second switching transistor M2 is turned on to provide the signal input by the control signal terminal SENSE to the second node N2, the signal input by the control signal terminal SENSE is a reference signal, the voltage value of the reference signal is $V_{ref}$, and $V_2=V_{ref}$ is satisfied for the voltage value $V_2$ of the second node N2, and data signals are written to the pixel circuits in the N-th row so that the pixel circuits in the N-th row output a driving current again, thereby ensuring the display effect. In the pixel circuits in the N+1-th row, the input signal of the first scanning terminal G1(N+1) is at a low level, and data signals are no longer written to the pixel circuits in the N+1-th row.

The fourth stage S4 and the fifth stage S5 can be interchanged in order after sensing of the pixel circuits in the N-th row has been completed in the first stage S1 to the third stage S3.

As can be known according to the above analysis, in the pixel circuit provided by an exemplary embodiment, rewriting of data signals to the pixel circuit may be achieved by controlling the signals of the first node and the second node through the first scanning terminal, and the input signal of the second scanning terminal is at a low level at the time of writing data signals. According to the pixel circuit provided by an exemplary embodiment, normal writing of the data signals to the pixel circuits in a next row can be ensured after sensing of the pixel circuits in a certain row in the sensing stage, thus ensuring the normal display and improving the display effect.

Figure 17:
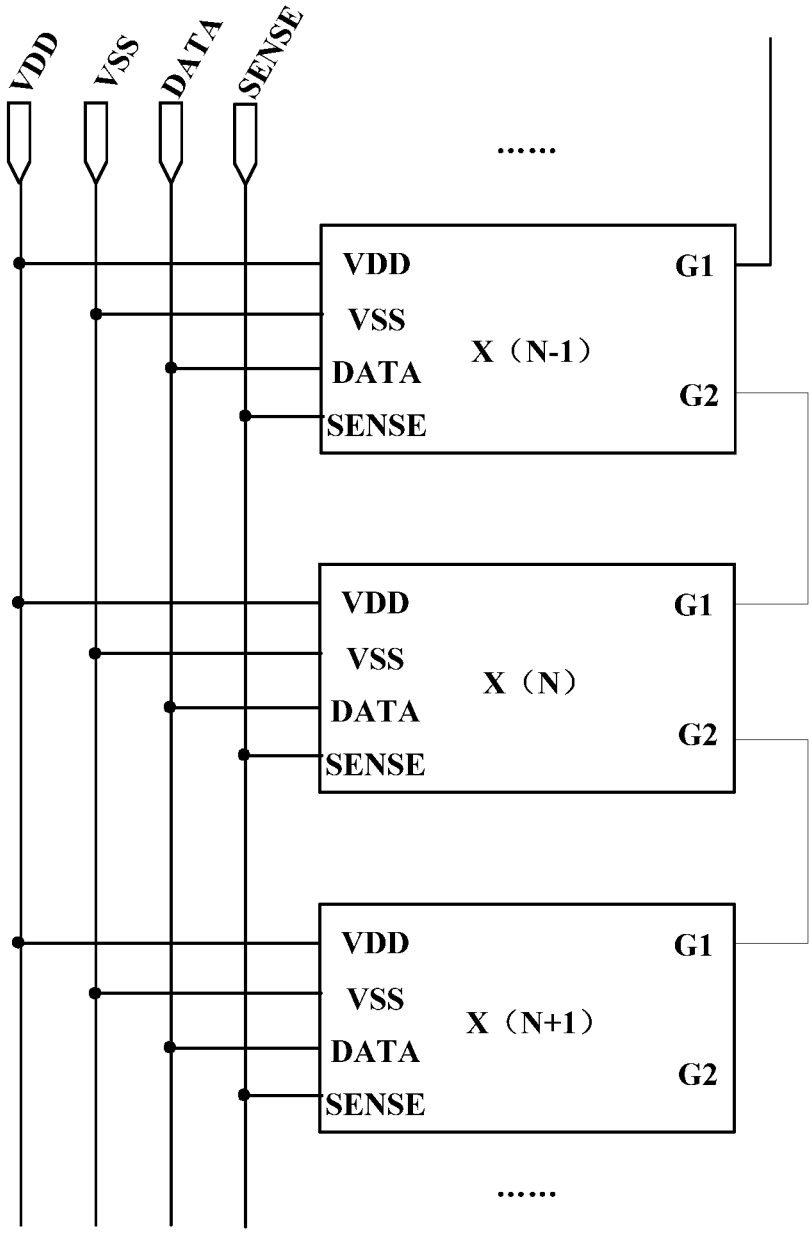
FIG. 17 is a schematic structural diagram of a display apparatus according to an embodiment of the present disclosure.

An embodiment of the present disclosure further provides a display apparatus. FIG. 17 is a schematic structural diagram of a display apparatus according to an embodiment of the present disclosure. As shown in FIG. 17, the display apparatus provided by an embodiment of the present disclosure includes: P rows and Q columns of pixel circuits.

In an exemplary embodiment, both P and Q are positive integers greater than 1. FIG. 17 illustrates one column of pixel circuits as an example. X(N−1) represents the pixel circuit in the N−1-th row in the one column of pixel circuits, X(N) represents the pixel circuit in the N-th row in the one column of pixel circuits, and so on.

As shown in FIG. 17, in an exemplary embodiment, the second scanning terminal G2 of the pixel circuit X(i) in the i-th row is electrically connected with the first scanning terminal G1 of the pixel circuit X(i+1) in the i+1-th row, $1 \le i \le P-1$.

Figure 18:
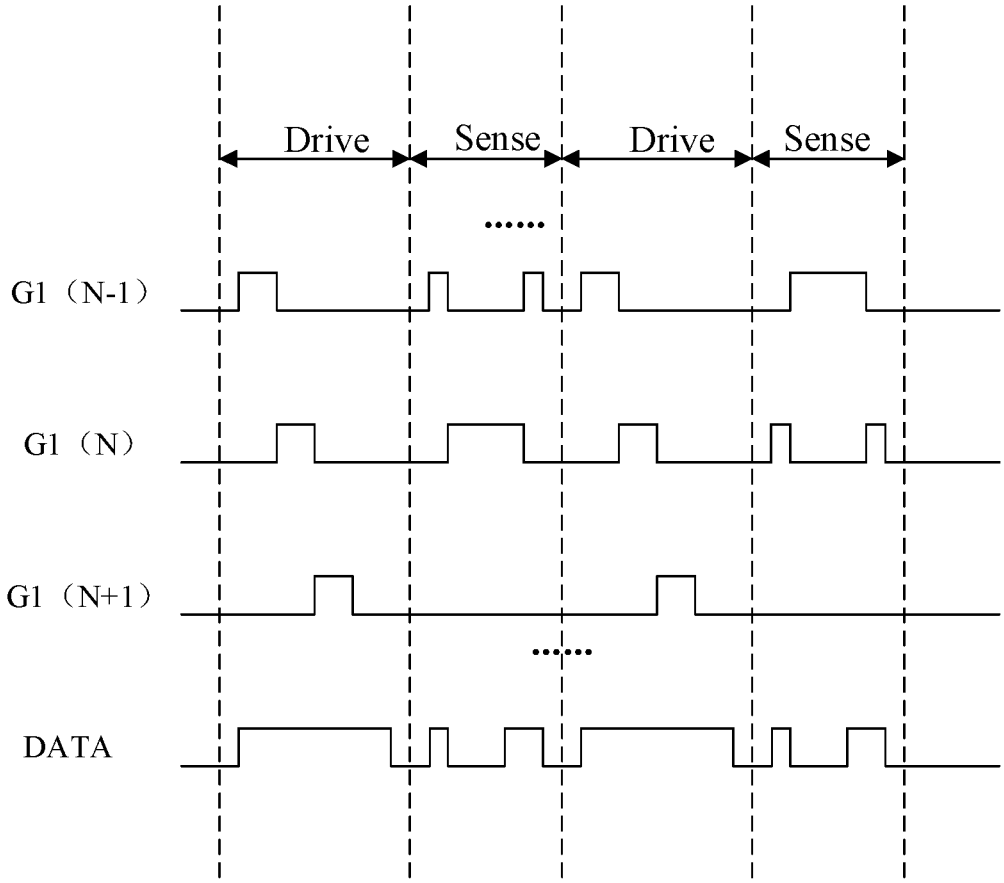
FIG. 18 is a timing diagram of a pixel circuit in the scanning stage and the sensing stage according to an exemplary embodiment.

FIG. 18 is a timing diagram of a pixel circuit in the scanning stage and the sensing stage according to an exemplary embodiment. G1(*i*) refers to the first scanning terminal of the pixel circuits in the i-th row. FIG. 18 illustrates the pixel circuits in the N−1-th row randomly selected as an example. The first scanning terminal G1(N−1) of the pixel circuits in the N−1-th row and the first scanning terminal G1(N) of the pixel circuits in the N-th row do not continuously provide low level signals, while the first scanning terminal of the other pixel circuits, such as the first scanning terminal G1(N+1) of the pixel circuits in the N+1-th row, continuously provides low level signals.

The pixel circuit is the pixel circuit provided in any of the previous embodiments, with similar implementation principle and implementation effect, which will not be repeated here.

In an exemplary embodiment, the display apparatus provided by an exemplary embodiment may further include a gate driving circuit. The gate driving circuit includes: a P-stage shift register, an output terminal of the i-th-stage shift register is electrically connected with the first scanning terminal of the pixel circuits in the i-th row.

In an exemplary embodiment, the data signal terminals electrically connected with the pixel circuits in the same column are the same signal terminal, and the control signal terminals electrically connected with the pixel circuits in the same column are the same signal terminal.

In an exemplary embodiment, the control signals of the first scanning terminal and the second scanning terminal are both provided by the gate driving circuit, which can reduce the use of signal lines, thereby simplifying the wiring of the pixel circuits, and can achieve narrow borders, thereby increasing the number of pixels displayed per unit area.

Figure 19:
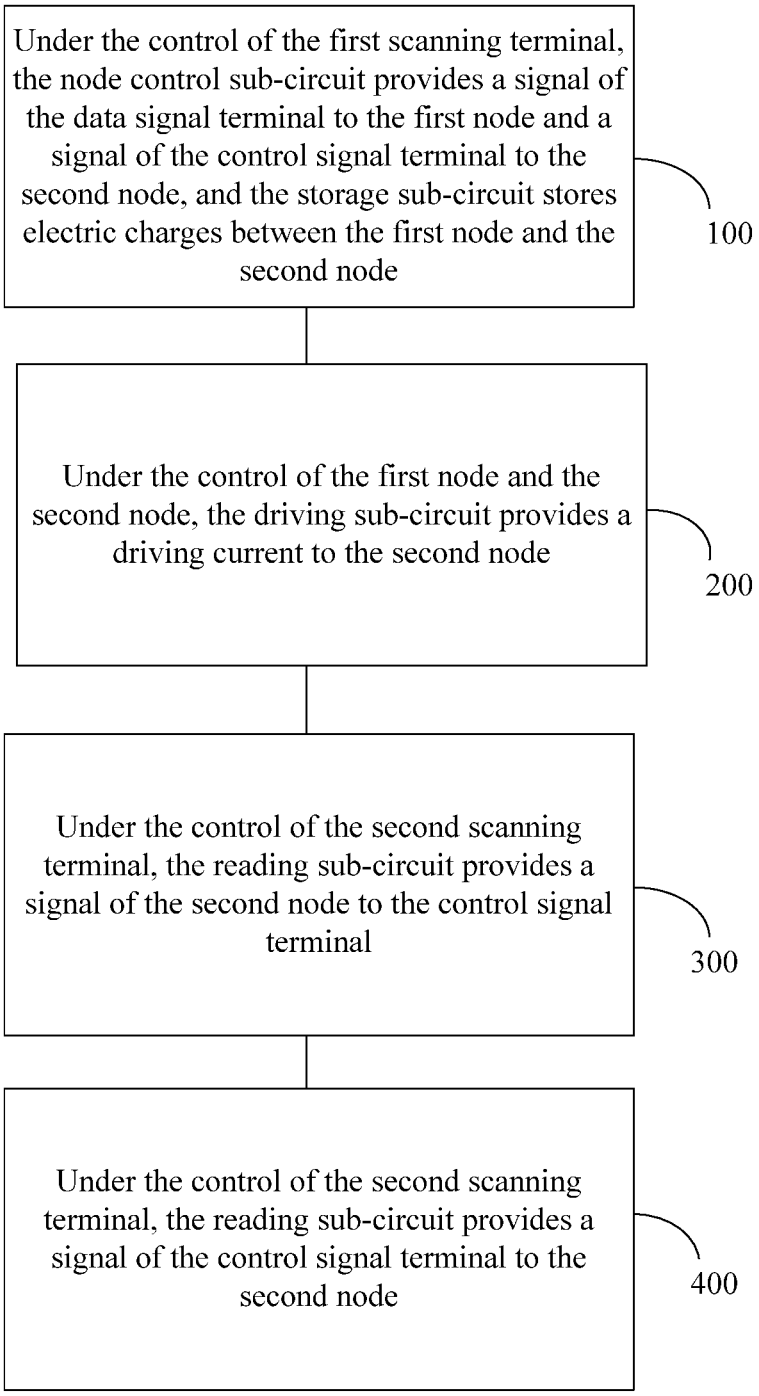
FIG. 19 is a flowchart of a method for driving a pixel circuit in the sensing stage according to an exemplary embodiment.

An embodiment of the present disclosure further provides a method for driving a pixel circuit, applied to the pixel circuit. When display is driven, a driving time sequence of the pixel circuit includes a scanning stage and a sensing stage. FIG. 19 illustrates a flowchart of a method for driving a pixel circuit in the sensing stage according to an exemplary embodiment, as shown in FIG. 19, in the sensing stage, the method for driving a pixel circuit provided by an embodiment of the present disclosure includes acts 100 to 400.

In act 100, under the control of the first scanning terminal, the node control sub-circuit provides a signal of the data signal terminal to the first node and a signal of the control signal terminal to the second node, and the storage sub-circuit stores electric charges between the first node and the second node.

In act 200, under the control of the first node and the second node, the driving sub-circuit provides a driving current to the second node.

In act 300, under the control of the second scanning terminal, the reading sub-circuit provides a signal of the second node to the control signal terminal.

In act 400, under the control of the second scanning terminal, the reading sub-circuit provides a signal of the control signal terminal to the second node.

The pixel circuit is the pixel circuit provided in any of the previous embodiments, with similar implementation principle and implementation effect, which will not be repeated here.

In an exemplary embodiment, in the scanning stage, the method for driving a pixel circuit includes: under the control of the first scanning terminal, providing, by the node control sub-circuit, a signal of the data signal terminal to the first node and a signal of the control signal terminal to the second node, and storing, by the storage sub-circuit, electric charges between the first node and the second node; and providing, by the driving sub-circuit, a driving current to the second node, under the control of the first node and the second node.

In an exemplary embodiment, when the signal of the first scanning terminal is at a valid level, the signal of the second scanning terminal is at an invalid level; and when the signal of the second scanning terminal is at a valid level, the signal of the first scanning terminal is at an invalid level. In act 100, the signal of the first scanning terminal is at a valid level, and in acts 200 to 400, the signal of the first scanning terminal is at an invalid level. In act 100, the signal of the first scanning terminal is at an invalid level, and in acts 200 to 400, the signal of the second scanning terminal is at a valid level.

In an exemplary embodiment, when the reading sub-circuit does not provide the signal of the second node to the control signal terminal, the signal of the control signal terminal is a reference signal. In act 100 and act 400, the signal of the control signal terminal is a reference signal.

In an exemplary embodiment, the voltage value of the reference signal is smaller than the voltage value of the signal of the second power supply terminal, which can ensure the display effect of the display.

The drawings in the present disclosure only involve the structures included in the embodiments of the present disclosure, and common designs may be referred to for other structures.

Although the embodiments disclosed in the present disclosure are as described above, the described contents are only the embodiments for facilitating understanding of the present disclosure, which are not intended to limit the present disclosure. Any person skilled in the art to which the present disclosure pertains may make any modifications and variations in the form and details of implementation without departing from the spirit and scope of the present disclosure. Nevertheless, the scope of patent protection of the present disclosure shall still be determined by the scope defined by the appended claims.

What we claim is:

1. A pixel circuit for driving a light-emitting element, comprising:

a node control sub-circuit, a driving sub-circuit, a storage sub-circuit and a reading sub-circuit, wherein the node control sub-circuit is electrically connected with a first scanning terminal, a first node, a second node, a data signal terminal and a control signal terminal, and is configured to provide a signal of the data signal terminal to the first node and a signal of the control signal terminal to the second node, under control of the first scanning terminal;

the driving sub-circuit is electrically connected with the first node, a first power supply terminal and the second node, and is configured to provide a driving current to the second node, under control of the first node and the second node;

the storage sub-circuit is electrically connected with the first node and the second node, and is configured to store electric charges between the first node and the second node;

the reading sub-circuit is electrically connected with a second scanning terminal, the second node and the control signal terminal, and is configured to provide a signal of the control signal terminal to the second node or a signal of the second node to the control signal terminal, under the control of the second scanning terminal; and the light-emitting element is electrically connected with the second node and a second power supply terminal.

2. A method for driving a pixel circuit, applied to the pixel circuit according to claim 1, wherein when display is driven, a driving time sequence of the pixel circuit comprises a scanning stage and a sensing stage, and in the sensing stage, the method comprises:

under the control of the first scanning terminal, providing, by the node control sub-circuit, the signal of the data signal terminal to the first node and the signal of the control signal terminal to the second node, and storing, by the storage sub-circuit, electric charges between the first node and the second node;

providing, by the driving sub-circuit, the driving current to the second node under the control of the first node and the second node;

providing, by the reading sub-circuit, the signal of the second node to the control signal terminal under the control of the second scanning terminal; and providing, by the reading sub-circuit, the signal of the control signal terminal to the second node under the control of the second scanning terminal.

3. The method according to claim 2, wherein in the scanning stage, the method comprises:

under the control of the first scanning terminal, providing, by the node control sub-circuit, the signal of the data signal terminal to the first node and the signal of the control signal terminal to the second node, and storing, by the storage sub-circuit, electric charges between the first node and the second node; and providing, by the driving sub-circuit, the driving current to the second node under the control of the first node and the second node.

4. The method according to claim 3, wherein when a signal of the first scanning terminal is at a valid level, a signal of the second scanning terminal is at an invalid level, and when the signal of the second scanning terminal is at a valid level, the signal of the first scanning terminal is at an invalid level;

when the reading sub-circuit does not provide the signal of the second node to the control signal terminal, the signal of the control signal terminal is a reference signal.

5. The method according to claim 2, wherein when a signal of the first scanning terminal is at a valid level, a signal of the second scanning terminal is at an invalid level, and when the signal of the second scanning terminal is at a valid level, the signal of the first scanning terminal is at an invalid level;

when the reading sub-circuit does not provide the signal of the second node to the control signal terminal, the signal of the control signal terminal is a reference signal.

6. The method according to claim 5, wherein a voltage value of the reference signal is smaller than a voltage value of a signal of the second power supply terminal.

7. The pixel circuit according to claim 1, wherein the node control sub-circuit comprises: a first node control sub-circuit and a second node control sub-circuit, the first node control sub-circuit is electrically connected with the first scanning terminal, the data signal terminal and the first node, and is configured to provide the signal of the data signal terminal to the first node under the control of the first scanning terminal; and the second node control sub-circuit is electrically connected with the first scanning terminal, the second node and the control signal terminal, and is configured to provide the signal of the control signal terminal to the second node under the control of the first scanning terminal.

8. The pixel circuit according to claim 7, wherein the first node control sub-circuit comprises: a first switching transistor;

a control electrode of the first switching transistor is electrically connected with the first scanning terminal, a first electrode of the first switching transistor is electrically connected with the data signal terminal, and a second electrode of the first switching transistor is electrically connected with the first node.

9. The pixel circuit according to claim 7, wherein the second node control sub-circuit comprises: a second switching transistor;

a control electrode of the second switching transistor is electrically connected with the first scanning terminal, a first electrode of the second switching transistor is electrically connected with the control signal terminal, and a second electrode of the second switching transistor is electrically connected with the second node.

10. A display apparatus, comprising:

P rows and Q columns of pixel circuits, wherein P and Q are positive integers greater than 1; and each of the pixel circuits is the pixel circuit according to claim 1.

11. The display apparatus according to claim 10, wherein the second scanning terminal of the pixel circuits in the i-th row is electrically connected with the first scanning terminal of the pixel circuits in the i+1-th row, $1 \leq i \leq P-1$.

12. The display apparatus according to claim 10, wherein the display apparatus further comprises: a gate driving circuit;

the gate driving circuit comprises a P-stage shift register, wherein an output terminal of the i-th-stage shift register is electrically connected with the first scanning terminal of the pixel circuits in the i-th row, $1 \leq i \leq P$.

13. The pixel circuit according to claim 1, wherein the driving sub-circuit comprises: a driving transistor;

a control electrode of the driving transistor is electrically connected with the first node, a first electrode of the driving transistor is electrically connected with the first power supply terminal, and a second electrode of the driving transistor is electrically connected with the second node.

14. The pixel circuit according to claim 1, wherein the storage sub-circuit comprises: a storage capacitor;

a first terminal of the storage capacitor is electrically connected with the first node, and a second terminal of the storage capacitor is electrically connected with the second node.

15. The pixel circuit according to claim 1, wherein the reading sub-circuit comprises: a third switching transistor;

a control electrode of the third switching transistor is electrically connected with the second scanning terminal, a first electrode of the third switching transistor is electrically connected with the control signal terminal, and a second electrode of the third switching transistor is electrically connected with the second node.

16. The pixel circuit according to claim 1, wherein the node control sub-circuit comprises a first switching transistor and a second switching transistor, the storage sub-circuit comprises a storage capacitor, the reading sub-circuit comprises a third switching transistor, and the driving sub-circuit comprises a driving transistor;

a control electrode of the first switching transistor is electrically connected with the first scanning terminal, a first electrode of the first switching transistor is electrically connected with the data signal terminal, and a second electrode of the first switching transistor is electrically connected with the first node;

a control electrode of the second switching transistor is electrically connected with the first scanning terminal, a first electrode of the second switching transistor is electrically connected with the control signal terminal, and a second electrode of the second switching transistor is electrically connected with the second node;

a control electrode of the third switching transistor is electrically connected with the second scanning terminal, a first electrode of the third switching transistor is electrically connected with the control signal terminal, and a second electrode of the third switching transistor is electrically connected with the second node;

a control electrode of the driving transistor is electrically connected with the first node, a first electrode of the driving transistor is electrically connected with the first power supply terminal, and a second electrode of the driving transistor is electrically connected with the second node; and a first terminal of the storage capacitor is electrically connected with the first node, and a second terminal of the storage capacitor is electrically connected with the second node.

17. The pixel circuit according to claim 1, wherein when a signal of the first scanning terminal is at a valid level, a signal of the second scanning terminal is at an invalid level, and when the signal of the second scanning terminal is at a valid level, the signal of the first scanning terminal is at an invalid level.

* * * * *